US006138420A

United States Patent [19]

Fyfe

[11] Patent Number: 6,138,420

[45] Date of Patent: Oct. 31, 2000

[54] BLAST-RESISTANT BUILDING

[75] Inventor: Edward R. Fyfe, Del Mar, Calif.

[73] Assignee: Fyfe Co., LLC, San Diego, Calif.

[21] Appl. No.: 09/226,281

[22] Filed: Jan. 7, 1999

[51] Int. Cl.[7] ..... E04B 5/00

[52] U.S. Cl. ..... 52/262; 52/236.9; 403/231; 403/267

[58] Field of Search ..... 52/167.3, 262, 52/236.9, 236.7; 220/62.15, 62.19, 62.22, 88.1; 403/231, 265, 266, 267

[56] References Cited

U.S. PATENT DOCUMENTS

| | | | |
|---|---|---|---|
| D. 257,178 | 9/1980 | Nasvik | D25/58 |
| 874,939 | 12/1907 | Clayton et al. | 52/262 |
| 2,160,225 | 5/1939 | Newman | 52/262 |
| 3,110,981 | 11/1963 | Larner | 52/262 |
| 3,334,555 | 8/1967 | Nagin et al. | 94/3 |
| 3,619,457 | 11/1971 | Chandler et al. | 264/256 |
| 3,793,975 | 2/1974 | Duff | 114/65 A |
| 3,949,144 | 4/1976 | Duff | 428/414 |
| 4,013,598 | 3/1977 | Evans et al. | 260/13 |
| 4,019,301 | 4/1977 | Fox | 52/725 |
| 4,223,502 | 9/1980 | Robinson | 52/315 |
| 4,265,957 | 5/1981 | Severance et al. | 428/143 |
| 4,327,536 | 5/1982 | Ascher | 52/309.12 |
| 4,339,289 | 7/1982 | Lankard | 156/91 |
| 4,390,578 | 6/1983 | Brooks | 403/267 X |
| 4,404,158 | 9/1983 | Robinson | 264/263 |
| 4,531,857 | 7/1985 | Bettigole | 404/44 |
| 4,774,794 | 10/1988 | Grieb | 52/309.7 |
| 4,854,094 | 8/1989 | Clark | 52/79.7 X |
| 4,876,151 | 10/1989 | Eichen | 428/446 |
| 5,043,033 | 8/1991 | Fyfe | 156/71 |
| 5,599,082 | 2/1997 | Mlakar et al. | 220/88.1 X |
| 5,657,595 | 8/1997 | Fyfe et al. | 52/252 |
| 5,934,618 | 8/1999 | Kari et al. | 220/88.1 X |
| 5,979,684 | 11/1999 | Ohnishi et al. | 220/62.22 X |

*Primary Examiner*—Beth A. Stephan
*Assistant Examiner*—Brian E. Glessner
*Attorney, Agent, or Firm*—Calif Tervo

[57] ABSTRACT

Blast-resistant building (11) includes a structural connection (10) including at least one layer of fiber reinforced composite (90) bonded to each connected structural element (20,30) along the length of the connection between structural panel (20) and elongate anchoring structures (30), such as I-beam (40) or additional concrete panel (50). Layer of fiber reinforced composite (90) spans peripheral seam (36), internal seam (37), or both between the connected elements, providing a tensile force under load which tends to hold the elements together and to strengthen the connection while simultaneously providing ductility along the seam, lessening the risk of fracture of either element or the connection under atypical loading, such as from a blast. Connection (10) includes an elongate tension member, such as bolt (80), for attaching the various elements, and a force dampener, such as a rubber isolation washer (89), to increase the ductility of the connection. In another embodiment, connection (10) includes an elongate fastener, such as bolt (70), for securing layer (90) to each structural element (20,30) and preventing layer (90) from separating from the surface to which it is bonded under load.

13 Claims, 3 Drawing Sheets

FIG.1
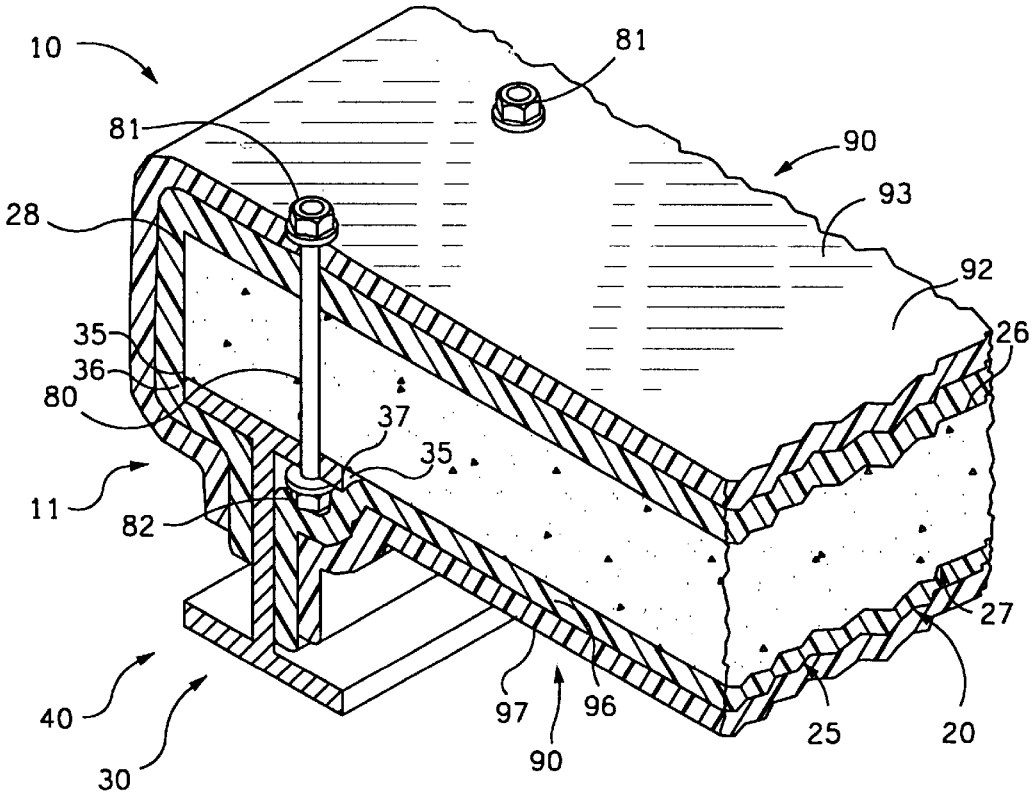
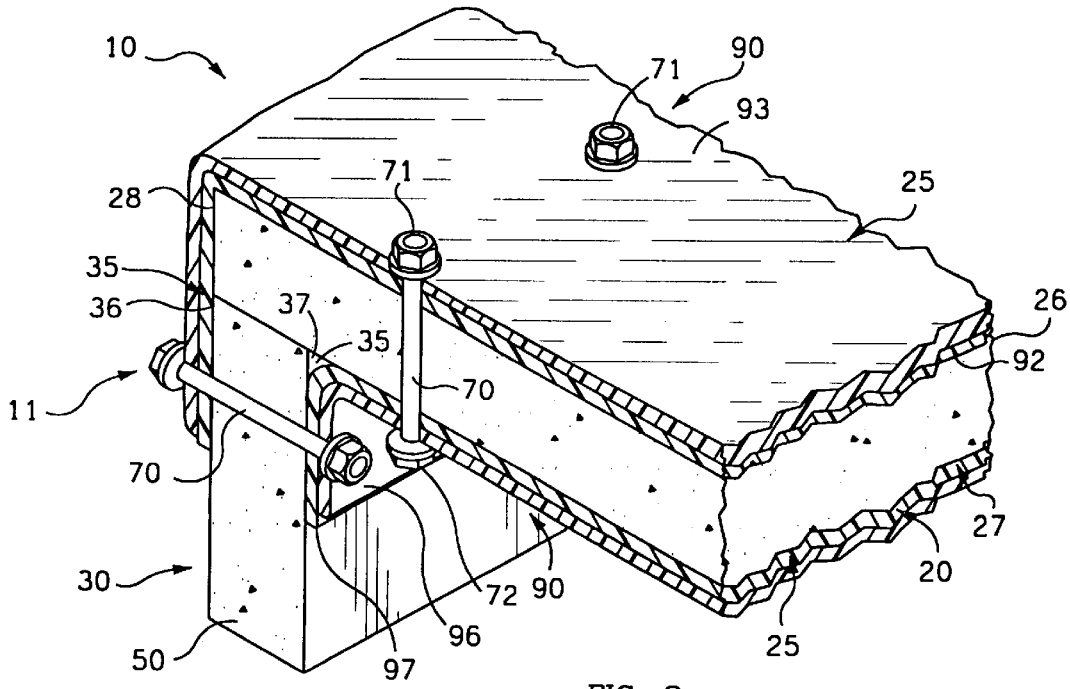
FIG. 2

FIG. 4
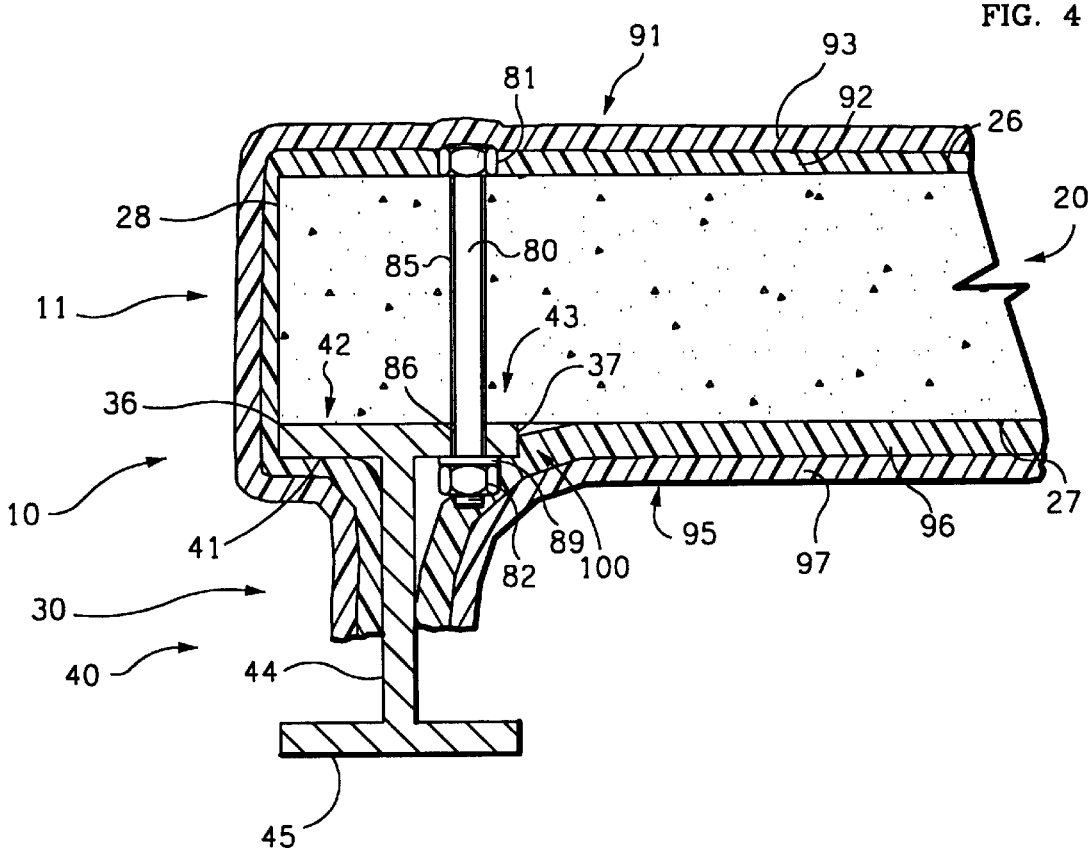
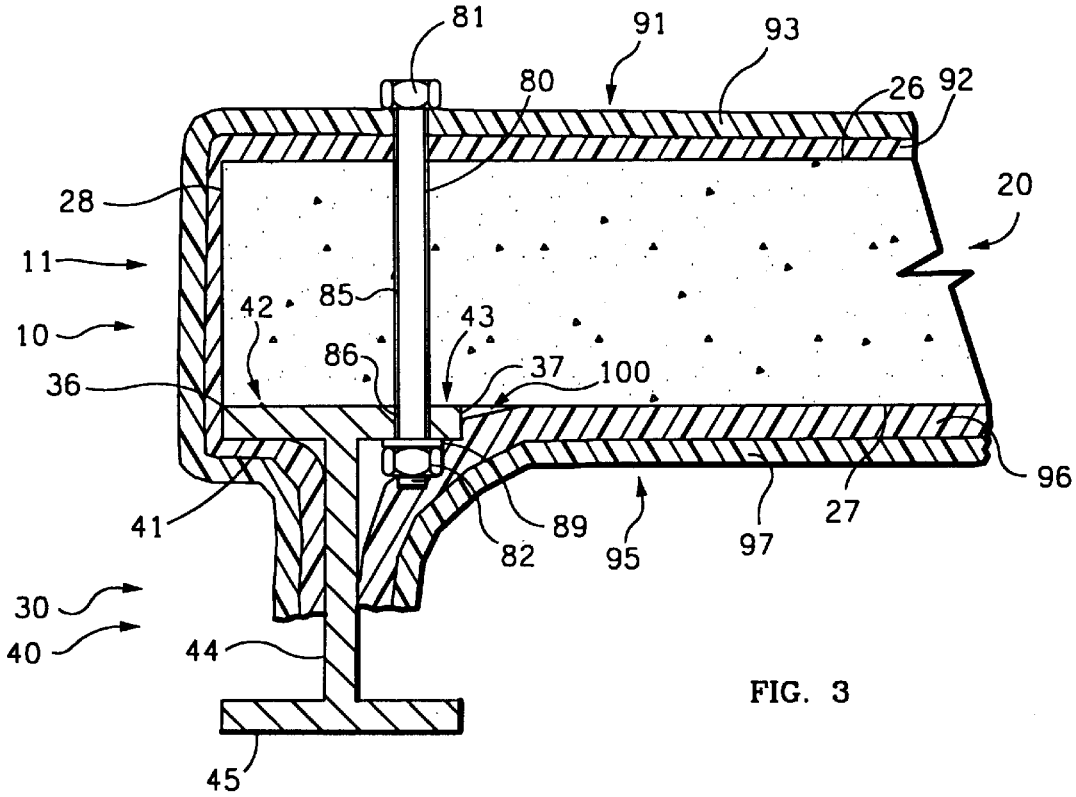
FIG. 3

FIG. 5
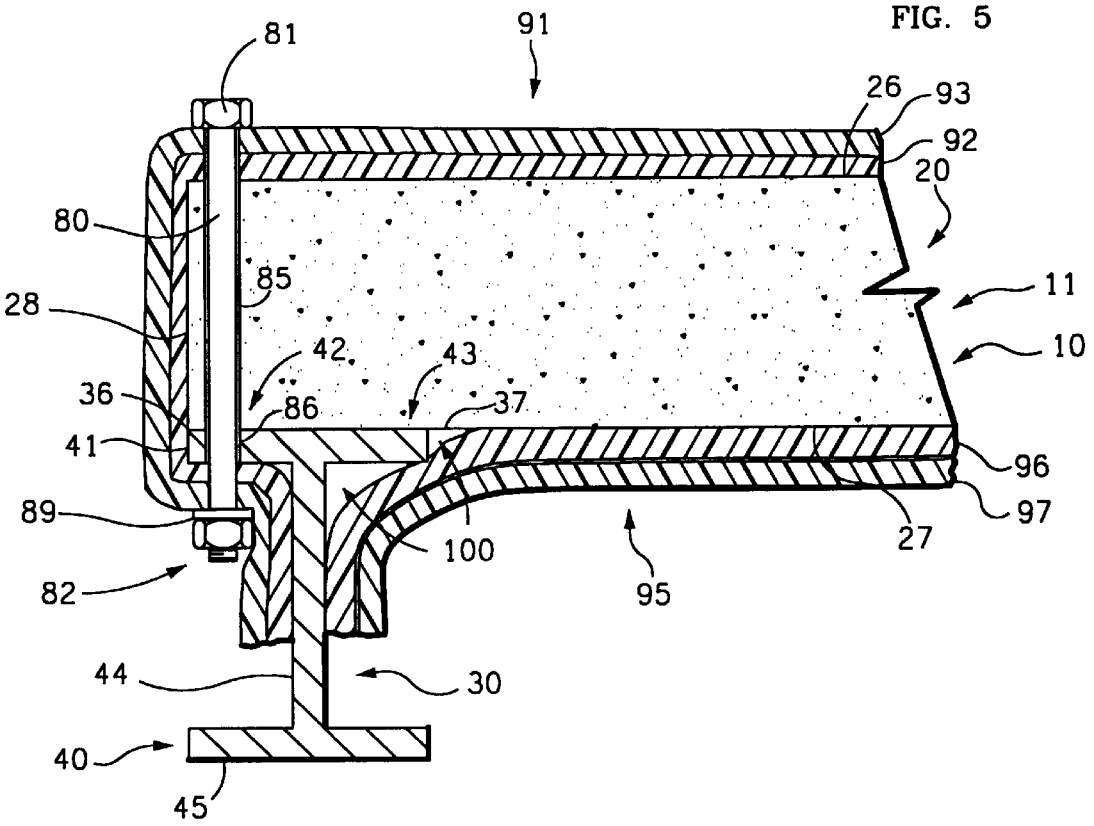
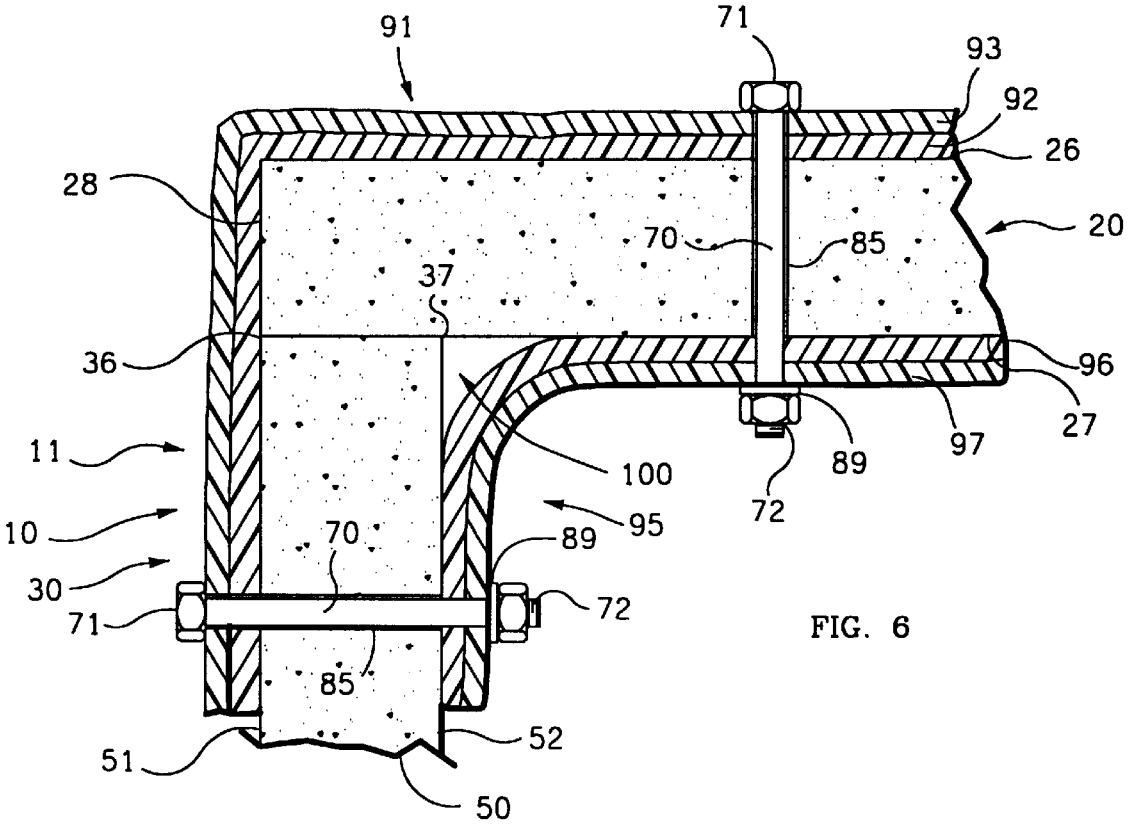
FIG. 6

BLAST-RESISTANT BUILDING

FIELD OF THE INVENTION

This invention relates to a blast-resistant building, and more particularly to a building having reinforced connections between concrete structural panels and adjacent support members providing for increased structural stability under fluctuating loads, such as during a blast or explosion.

BACKGROUND OF THE INVENTION

Many conventional buildings constructed of reinforced concrete are generally not well suited to withstand large seismic forces, and such buildings typically are not designed to withstand blast loading. Seismic forces can cause the structural elements in a building to vibrate or to deform, resulting in transfer of forces at the connections between the elements. A blast external to a building first creates a strong inward force (implosion), and then a resulting reflexive expansion (explosion) of the structure. If one force does not destroy the building, the other may well destroy it.

It has been proven by test and shown by analysis that the increased strength and ductility of building structural members achieved by applying fiber reinforced composites to concrete columns, beams, walls, slabs, and other elements can assist in preventing damage and collapse of these elements. When stresses, particularly shear stresses, are transferred between these individual elements, however, fracture and even catastrophic failure of the whole structure can occur at the connections between otherwise structurally sound elements.

Therefore, there has been a need for a building having improved connections between structural elements such that the reinforced connections can withstand atypical or fluctuating loads associated with earthquakes, explosions and other concussive forces, or the like.

Furthermore, it is additionally desirable to retro-fit existing building structures with the improved reinforced connections.

SUMMARY OF THE INVENTION

A blast-resistant building includes a structural panel, an elongate anchoring structure, and at least one layer of fiber reinforced composite which is bonded to each attached structural element along the length of the connection between the two structural elements. The layer of fiber reinforced composite spreads any applied forces over the entire covered area, thereby lessening the force applied at a particular point. The layer of fiber reinforced composite spans the seam between the elements, providing a tensile force under load which tends to hold the elements together and to strengthen the connection while simultaneously providing ductility along the seam, lessening the risk of fracture of either element or the connection under atypical loading.

The reinforced connection includes elongate tension members, such as bolts or rivets, extending through the structural panel and at least part of the elongate anchoring structure for rigidly connecting the members. Force dampening elements, such as rubber isolation washers, are included to increase the ductility of the connection.

The bolts or rivets may also secure the layer of fiber reinforced composite to each structural element to prevent the layer from separating under load from the surface to which it is bonded.

BRIEF DESCRIPTION OF THE DRAWINGS

FIG. 1 is a perspective partial cross-section view of a first preferred embodiment of the blast-resistant building of the invention.

FIG. 2 is a perspective partial cross-section view of a second preferred embodiment of the blast-resistant building of the invention.

FIG. 3 is an enlarged front elevation view of the connection of FIG. 1.

FIG. 4 is an enlarged front elevation view similar to FIG. 3 showing a second embodiment of the elongate tension member.

FIG. 5 is an enlarged front elevation view similar to FIG. 3 showing a third embodiment of the elongate tension member.

FIG. 6 is an enlarged front elevation view of the connection of FIG. 2.

DETAILED DESCRIPTION OF THE INVENTION

With reference now to the drawings, and particularly to FIGS. 1 and 2 thereof, FIG. 1 is a perspective partial cross-section view of a first preferred embodiment of the blast-resistant building 11 of the invention, and FIG. 2 is a perspective partial cross-section view of a second preferred embodiment of the blast-resistant building 11. Building 11 generally comprises a structural panel 20, an elongate anchoring structure 30, and a connection 10 comprising one or more layers of fiber reinforced composite 90 spanning seams 35, and a plurality of fasteners 70,80. Common structural panels 20 include floors, walls, ceilings and roofs or portions thereof, such as floor, roof, wall and ceiling slabs, and beams and columns. Structural panel 20 may be made of steel reinforced concrete, unreinforced concrete, masonry material, or other material common in construction. Panel 20 has faces 25, including an external face 26 and an internal face 27, and a peripheral edge 28. Panel 20 is anchored to elongate anchoring structure, denoted generally as 30.

Common anchoring structures 30 include floors, walls, ceilings and roofs or portions thereof, such as floor, roof, wall and ceiling slabs, and beams and columns. Although FIGS. 1–6 illustrate anchoring structures 30 vertically supporting panel 20, the invention also encompasses buildings 11 having non-vertically supporting blast-resistant structural connections 10, such as between a wall and a floor, connections 10 between a wall and a ceiling, and also connections 10 between adjacent walls. Also, while the figures show only one end of panel 20 supported by anchoring structures 30, the other end of panel 20, not shown in the figures, is similarly supported; a round panel would be peripherally supported.

Anchoring structures 30, such as structural I-beam 40 and structural panel 50, shown and described, are representative of typical conventional anchoring structures connected to structural panels 20. Structural panel 50 may be similar to panel 20. As best seen in FIGS. 3–6, each anchoring structure 30 is attached along its length to internal face 27 of structural panel 20 proximal peripheral edge 28 and defines a pair of seams 35, peripheral seam 36 and internal seam 37. Seams 35 run the length of the connection between panel 20 and anchoring structure 30. While the embodiments of seams 35 described herein and shown in the drawings are generally linear, it should be noted that the invention also encompasses angled, curved, or other non-linear seams 35 resulting from the connections of non-linear panels 20, non-linear anchoring structures 30, or both.

FIG. 3 is an enlarged front elevation view of the connection 10 of FIG. 1 showing an elongate tension member, such as bolt 80. In FIG. 3, the connection 10 to be reinforced includes a structural panel 20 having an external face 26, an internal face 27, and a peripheral edge 28 and a structural I-beam 40 including a proximal flange 41, a web 44, and a distal flange 45. Proximal flange 41 includes peripheral portion 42 and internal portion 43.

Although an I-beam 40 is shown and described, the invention also encompasses similar structures such as box beams, concrete beams, or other elongate structures that are well known and commonly used in construction. A peripheral layer of fiber reinforced composite 91, which may include one or more layers of fiber reinforced composite such as first peripheral layer 92 and second peripheral layer 93, is bonded, by means well-known in the art, such as by epoxy, to external face 26 of panel 20. Preferably, peripheral layer 91 covers entire external face 26 to provide panel 20 with increased ductility and shear resistance. First peripheral layer 92 spans peripheral seam 36 and is further bonded directly to structural I-beam 40. When applied forces, such as from a blast, would otherwise cause panel 20 and I-beam 40 to tend to separate, layer 92 acts as a tension element, holding the structural members together at peripheral seam 36. Layer 92 also spreads shear forces over its entire area, lessening the magnitude of local forces at a particular point and providing ductility at peripheral seam 36.

FIG. 3 also shows a reinforced internal seam 37. An internal layer of fiber reinforced composite 95, which may include one or more layers of fiber reinforced composite such as first internal layer 96 and second internal layer 97, is bonded, by means well-known in the art, such as by epoxy, to internal face 27 of panel 20. Preferably, internal layer 95 covers entire internal face 27 to provide panel 20 with increased ductility and shear resistance. First internal layer 96 spans internal seam 37 and is further bonded directly to structural I-beam 40. When applied forces, such as from a blast, would otherwise cause panel 20 and Ibeam 40 to tend to separate, layer 96 acts as a tension element, holding the structural members together at internal seam 37. Layer 96 also spreads shear forces over its entire area, lessening the magnitude of local forces at a particular point and providing ductility at internal seam 37.

In the preferred embodiment of such a reinforced internal seam 37, a layer of ductile adhesive material 100, such as epoxy, is deposited along internal seam 37 beneath first internal layer 96. Adhesive material 100 is bonded to both internal face 27 of panel 20 as well as to internal portion 43 of proximal flange 41 of structural I-beam 40 to strengthen and to add ductility and stress resistance to connection 10.

FIG. 6 is an enlarged front elevation view of the connection 10 of FIG. 2 showing a plurality of elongate fastening members, such as bolts 70. In FIG. 6, the connection 10 to be reinforced includes a structural panel 20 having an external face 26, an internal face 27, and a peripheral edge 28 and an additional structural panel 50 having an external face 51 and an internal face 52. Peripheral layer of fiber reinforced composite 91, including first peripheral layer 92 and second peripheral layer 93, is bonded, by means well-known in the art, such as by epoxy, to external face 26 of panel 20. First peripheral layer 92 covers external face 26, spans peripheral seam 36, and is further bonded directly to external face 51 of panel 50. When applied forces, such as from a blast, would otherwise cause panels 20,50 to tend to separate, layer 92 acts as a tension element, holding the structural members together at peripheral seam 36. Layer 92 also spreads shear forces over its entire area, lessening the magnitude of local forces at a particular point and providing ductility at peripheral seam 36.

FIG. 6 also shows a reinforced internal seam 37. Internal layers of fiber reinforced composite 95, including first internal layer 96 and second internal layer 97, are bonded, by means well-known in the art, such as by epoxy, to internal face 27 of panel 20. First internal layer 96 covers internal face 27, spans internal seam 37, and is further bonded directly to internal face 52 of panel 50. When applied forces, such as from a blast, would otherwise cause panels 20,50 to tend to separate, layer 96 acts as a tension element, holding the structural members together at internal seam 37. Layer 96 also spreads shear forces over its entire area, lessening the magnitude of local forces at a particular point and providing ductility at internal seam 37.

In the preferred embodiment of such a reinforced internal seam 37, a layer of ductile adhesive material 100, such as epoxy, is deposited along internal seam 37 beneath first internal layer 96. Adhesive material 100 is bonded to both internal face 27 of panel 20 as well as to internal face 52 of panel 50 to strengthen and to add ductility and stress resistance to connection 10.

Returning now to FIG. 3, a preferred embodiment of a blast-resistant structural connection 10 is shown including rigid attachment means for rigidly attaching panel 20 to structural I-beam 40. Such rigid attachment means may include a plurality of elongate tension members, such as bolts 80 dispersed along seam 37. Each bolt 80 has an external compressive terminus, such as bolt-head 81, and an internal compressive terminus, such as nut 82. Bolt 80 may be extended through a bore 85 in panel 20 or it may be integral with panel 20, held in place while the concrete was allowed to set. Bolt 80 further is extended through bore 86 in proximal flange 41 of I-beam 40. Although bolt 80 is shown and described, it will be apparent to one skilled in the art that the invention also encompasses the use of rivets, screws, or similar structural fasteners. Preferably a plurality of bolts 80 are dispersed along the length of seam 37.

Bolt 80 extends through peripheral layer of fiber reinforced composite 91 and bolt-head 81 bears on layer 91. In the embodiment shown in FIG. 3, bolt-head 81 serves the additional function of securing layer 91 to panel 20. While FIG. 3 shows bolt-head 81 bearing on layer 91, it should be noted that other embodiments are contemplated. For example, FIG. 4 is an enlarged view of the connection 10 of FIG. 1 showing a second embodiment of bolt 80 wherein bolt-head 81 bears on external face 26 of panel 20 for applying a compressive force thereto. Bolt-head 81 may also be countersunk.

In FIGS. 3 and 4, nut 82 bears on proximal flange 41 of structural I-beam 40 for applying a compressive force thereto. In the preferred embodiment, force dampening means, such as a compressible member, such as rubber isolation washer 89, absorbs shock and reduces fluctuating or atypical forces transmitted through bolt 80 between panel 20 and I-beam 40. Rubber washer 89 is interposed either between nut 82 and the surface upon which it bears (i.e. proximal flange 41) or between bolt-head 81 and the surface upon which it bears (i.e. layer 91 as in FIG. 3, or external face 26 of panel 20 as in FIG. 4) to reduce effectively transmitted forces.

FIG. 5 is an enlarged view of the connection 10 of FIG. 1 showing a third embodiment of the elongate tension member. In FIG. 5, bolt 80 extends through peripheral layer of fiber reinforced composite 91 at a point where layer 91 is bonded to structural panel 20, through panel 20 itself, through peripheral portion 42 of proximal flange 41 of I-beam 40, and once again through layer 91 at a point where layer 91 is bonded to proximal flange 41. Bolt 80 thereby extends through layer 91 on each side of peripheral seam 36.

In this embodiment, in addition to rigidly attaching panel 20 to I-beam 40, bolt 80 performs another function in that both bolt-head 81 and nut 82 bear on layer 91. Layer 91 is thereby secured by mechanical means both to panel 20 and I-beam 40 on either side of peripheral seam 36. Securing layer 91 in this manner reduces the risk that layer 91 will separate from panel 20 or I-beam 40 under load. Preferably a plurality of bolts 80 are dispersed along the length of seam 36.

Returning now to FIG. 6, an enlarged front elevation view of the connection 10 of FIG. 2 is shown with elongate fastening members, such as bolts 70, extending through each panel 20,50 as well as through layers of fiber reinforced composite 91,95. Bolts 70 may be extended through bores 85 in panels 20,50 or may be integral with panels 20,50, held in place while the concrete was allowed to set. Bolts 70 each include an internal compressive terminus, such as nut 72, and an external compressive terminus such as bolt-head 71. Preferably a plurality of bolts 70 are dispersed along each seam 36,37.

Peripheral layer 91 is bonded to, and preferably substantially covers, external face 26 of panel 20, spans peripheral seam 36, and is further bonded directly to external face 51 of panel 50. Internal layer 95 is bonded to, and preferably substantially covers, internal face 27 of panel 20, spans internal seam 37, and is further bonded directly to internal face 52 of panel 50. Bolt 70 extends through layers 91,95, bolt-head bears on peripheral layer 91, and nut 72 bears on internal layer 95.

Although FIG. 6 shows both peripheral layer 91 and internal layer 95 and each layer 91,95 having two layers 92,93 and 96,97 respectively, it can be seen that bolt 70 can be utilized if either layer 91,95 is not present or if either layer has only one constituent layer 92,96. In the manners described above, layer 90 is thereby secured by mechanical means both to panel 20 and panel 50 on either side of reinforced seams 35. Securing layer 90 in this manner reduces the risk that layer 90 will separate from panels 20,50 under load.

It is desirable to select a fiber cloth with elongation properties acceptable for use within the range of expected loading, or to use other materials with higher elongation properties for use in reinforcing the composite layer.

In many instances, the fiber cloth used in reinforcing composite layers has a general fiber direction; i.e. the majority of the fibers are oriented such that they are substantially parallel to each other. Where such a unidirectional cloth is employed, both the cloth itself and the layer of composite reinforced with it generally exhibit greater tensile performance in the direction of the fibers. For this reason, given the tensile role of layer of fiber reinforced composite 90, it is preferred that such a layer 90 employing unidirectional fibers be applied such that the fibers therein are oriented at an angle of at least 45 degrees relative to the reinforced seam 35. In another preferred embodiment, layer of fiber reinforced composite 90 is applied such that the fibers therein are oriented substantially perpendicular to the reinforced seam 35. With the fibers crossing seam 35, greater tensile strength at connection 10 increases structural stability.

If second layers 93,97 are employed as shown in FIGS. 1–6, preferably the direction of their fibers is substantially perpendicular to the direction of the fibers contained in their respective underlying layer 92,96.

Preferably, composite layer 90 spans entire face 25 of structural panel 20 and covers seams 35 on each side.

It can be seen that the present invention provides a building having very reliable structural connections reinforced to withstand blast loading or fluctuating seismic forces. Such connections may be perfected while the structure is under construction, or an existing structure may be retro-fitted with the improved blast-resistant connections.

Although particular embodiments of the invention have been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

Having thus described my invention, I claim:

1. A blast-resistant structure comprising:

at least one structural panel having an external face, an internal face, and a peripheral edge;

an elongate anchoring structure; said elongate anchoring structure attached along its length to said internal face of said structural panel proximal said peripheral edge and defining a peripheral seam and an internal seam;

a first layer of fiber reinforced composite bonded to at least one of said faces of said structural panel, spanning at least one of said seams, and further bonded to said elongate anchoring structure; and an elongate tension member extending through said structural panel and at least part of said elongate anchoring structure; said elongate tension member including:

a first compressive terminus applying a compressive force to said structural panel; and a second compressive terminus applying a compressive force to said elongate anchoring structure.

2. The blast-resistant structure of claim 1 wherein said first layer of fiber reinforced composite is bonded to said internal face of said structural panel, spans said internal seam, and is further bonded to said elongate anchoring structure.

3. The blast-resistant structure of claim 1 wherein said first layer of fiber reinforced composite is bonded to said external face of said structural panel, spans said peripheral seam, and is further bonded to said elongate anchoring structure.

4. The blast-resistant structure of claim 1 wherein said first layer of fiber reinforced composite is bonded to said external face of said structural panel, spans said peripheral seam, and is further bonded to said elongate anchoring structure, and further comprising:

a second layer of fiber reinforced composite bonded to said internal face of said structural panel, spanning said internal seam, and further bonded to said elongate anchoring structure.

5. The blast-resistant structure of claim 1 wherein said first layer of fiber reinforced composite is applied such that the fibers therein are oriented at an angle of at least 45 degrees relative to said spanned seam.

6. The blast-resistant structure of claim 5 further comprising:

a second layer of fiber reinforced composite bonded to said first layer of fiber reinforced composite wherein the fibers in said second layer are oriented substantially perpendicular to the fibers in said first layer.

7. The blast-resistant structure of claim 1 wherein said first layer of fiber reinforced composite is applied such that the fibers therein are oriented substantially perpendicular to said spanned seam.

8. The blast-resistant structure of claim 1 wherein said elongate tension member further extends through said first layer of fiber reinforced composite and wherein at least one of said compressive terminuses is adapted to apply a compressive force to said first layer of fiber reinforced composite.

9. The blast-resistant structure of claim 1 further comprising:

at least one compressible member interposed between at least one of said compressive terminuses and the surface upon which said compressive terminus bears for reducing fluctuating forces transmitted therebetween.

10. The blast-resistant structure of claim 3 wherein said elongate tension member further extends through:

said first layer of fiber reinforced composite at a point where said first layer is bonded to said structural panel; said structural panel; part of said elongate anchoring structure; and said first layer of fiber reinforced composite at a point where said first layer is bonded to said elongate anchoring structure; said elongate tension member thereby extending through said first layer of fiber reinforced composite on each side of said peripheral seam; and wherein each said compressive terminus of said elongate tension member applies a compressive force to said first layer of fiber reinforced composite.

11. The blast-resistant structure of claim 10 further comprising:

a second layer of fiber reinforced composite bonded to said internal face of said structural panel, spanning said internal seam, and further bonded to said elongate anchoring structure.

12. The blast-resistant structure of claim 1 further comprising:

one or more additional elongate tension members dispersed along said spanned seam; each said additional elongate tension member extending through said structural panel and at least part of said elongate anchoring structure and including:

a first compressive terminus applying a compressive force to said structural panel; and a second compressive terminus applying a compressive force to said elongate anchoring structure.

13. The blast-resistant structure of claim 1 wherein said structural panel is composed of concrete.

* * * * *